US006832568B2

(12) United States Patent
Beverly

(10) Patent No.: US 6,832,568 B2
(45) Date of Patent: Dec. 21, 2004

(54) TUFTING MACHINE NEEDLE

(75) Inventor: Ian Beverly, Lancashire (GB)

(73) Assignee: Spencer Wright Industries, Inc., Dalton, GA (US)

( * ) Notice: Subject to any disclaimer, the term of this patent is extended or adjusted under 35 U.S.C. 154(b) by 0 days.

(21) Appl. No.: 10/673,845

(22) Filed: Sep. 29, 2003

(65) Prior Publication Data

US 2004/0149193 A1 Aug. 5, 2004

(30) Foreign Application Priority Data

Jan. 31, 2003 (GB) ..... 0302295
Jul. 21, 2003 (GB) ..... 0317015

(51) Int. Cl.[7] ..... D05B 85/00; D05C 15/20
(52) U.S. Cl. ..... 112/80.16; 112/222
(58) Field of Search ..... 112/80.16, 80.01–870.04, 112/80.15, 80.45, 80.5, 98, 222, 223, 224, 225; 223/102; 163/1, 5; 606/222, 223

(56) References Cited

U.S. PATENT DOCUMENTS

| | | | | | |
|---|---|---|---|---|---|
| 358,490 | A | * | 3/1887 | Simons | 112/80.03 |
| 780,970 | A | * | 1/1905 | Bledsoe | 112/80.03 |
| 2,975,736 | A | * | 3/1961 | Card | 112/80.5 |
| 3,364,888 | A | * | 1/1968 | Sibley, Jr. et al. | 112/80.18 |
| 4,103,630 | A | * | 8/1978 | Wignall | 112/80.15 |
| 4,563,961 | A | * | 1/1986 | Beyer et al. | 112/222 |

* cited by examiner

*Primary Examiner*—Ismael Izaguirre
(74) *Attorney, Agent, or Firm*—Stephen J. Stark; Miller & Martin PLLC

(57) ABSTRACT

A tufting needle which has a transverse eye between the blade of the needle an the point and has a clearance above the eye in the blade on one side and has no yarn guide and protection groove on the opposite side. Also, disclosed is a conventional tufting needle which has the conventional yarn guide and protection groove.

4 Claims, 5 Drawing Sheets

TUFTING MACHINE NEEDLE

BACKGROUND OF THE INVENTION

1. Field of the Invention

The present invention relates to a needle for a tufting machine.

2. Description of Related Art

A plurality of needles are provided across the width of the tufting machine. Each needle is threaded with an individual yarn when it is spaced from the backing cloth. In operation the point of the needle first penetrates the backing cloth and continuing movement of the needle pulls the yarn through the backing cloth. On the underside of the backing cloth, the yarn is picked up by a hook or looper which holds the loop of yarn while the needle is retracted back through the backing cloth.

The tufting needle was originally developed from a sewing machine needle. In all solid, non-hollow tufting needles, a yarn protection groove is provided running along the shank of the needle to protect the yarn during the needle penetration into the backing material. A hook lead-in chamfer is generally provided to facilitate the pick up of the yarn by the hook from the needle.

SUMMARY OF THE INVENTION

According to the present invention there is provided a solid, non-hollow tufting machine needle with a hook lead-in chamfer and without a yarn protection groove.

The inventor has found that, contrary to conventional wisdom, the yarn protection groove is not necessary in a tufting needle and eliminating it can even provide certain advantages.

With a yarn protection groove, the yarn crosses the wall of the yarn protection groove in an angular direction at the point of needle penetration into the backing cloth. Thus results in yarn being trapped between the needle wall and the backing cloth, and also rolls or twists the yarn during the stroke of the needle. This interruption of the yarn flow often creates unevenness on the carpet surface, especially of loop pile fabrics.

Once the yarn has passed through the backing cloth, the yarn protection groove is unnecessary as there is no yarn restriction and adequate clearance.

Thus, in effect, it has been found that the yarn protection groove provides little or no benefit.

By eliminating the yarn protection groove, the needle is stronger and considerably less expensive to manufacture as it does not need to have a complex structure with varying sections of thickness. The manufacturing process can be simplified as multiple die pressing operations and can be reduced or even eliminated.

The invention also opens up the possibility of producing needles from a flat plate, suitable for moulding in a needle module, or a round bar with a machined or a flat pressed working area for single needles which are inserted into round holes drilled in a needle bar.

Also, due to the simplicity of the design, the needles can be produced using conventional machine tools, including wire erosion (EDM) instead of the special purpose machines necessary with the conventional design. The needle can also be moulded in tungsten, powder steel metallurgy and tough nylons.

The additional strength gained by eliminating the groove has resulted in smaller section needles. This, amongst other things, reduces the size of the needle penetration hole in the backing cloth which has significant advantages in tuft retention and backing cloth strength. This is particularly important when tufting into non-woven backing cloths, especially in the automotive industry where backing cloth strength is vital during the moulding operation of carpets.

As the yarn protection groove has been eliminated, the lead-in chamfer can be made wider and more gradual, as compared to a conventional needle thereby improving the hook or looper pick-up.

In order to compensate for the elimination of the yarn protection groove, a chamfer may be provided on the yarn inlet sides of the needle, although this is not believed to be necessary. Alternatively, with a flat plate configuration, the needle can be angled such that the plane of the flat plate is angled with respect to the direction in which, in use, the backing passes through the tufting machine.

In order to smooth the passage of the yarn through the eye, chamfers are preferably provided on the inlet and outlet to the eye.

The invention also extends to a needle module having a plurality of needles according to the invention.

The present invention also extends to a tufting machine having a plurality of needles arranged across the machine, each being arranged to be threaded with an individual yarn when the needle is spaced from a backing material which, in use, is fed through the machine in a direction transverse to the direction in which the needles are arranged, wherein each needle is arranged to penetrate the backing material thereby pulling its yarn through the backing material, and a respective hook or looper is arranged to pick up the loop of yarn from each needle and to hold the loop as the needle is retracted; wherein each needle is a solid, non-hollow needle without a yarn protection groove.

BRIEF DESCRIPTION OF THE DRAWINGS

Examples of a standard tufting needle and a tufting needle in accordance with the present invention will now be described with reference to the accompanying drawings, in which.

DESCRIPTION OF THE PREFERRED EMBODIMENTS

Figure 1A:
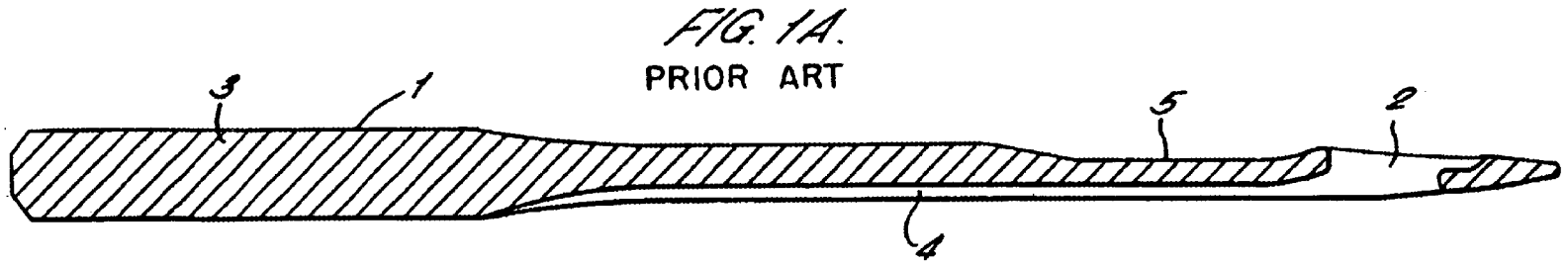
FIG. 1A. PRIOR ART
FIG. 1A is a cross-section through a conventional needle.
Figure 1B:
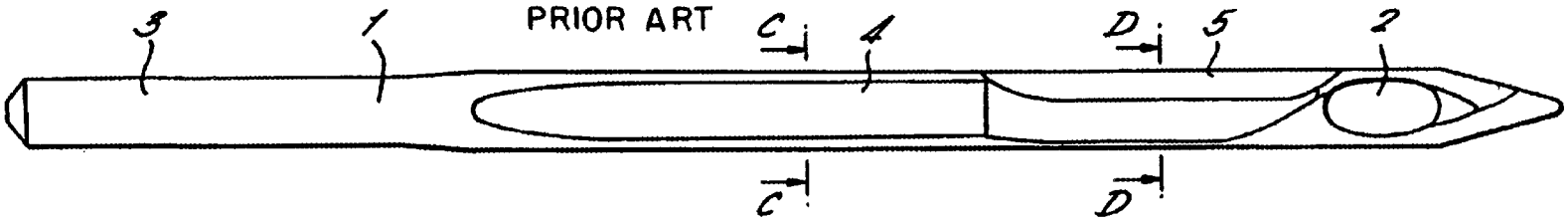
FIG. 1B. PRIOR ART
FIG. 1B is a plan view of a conventional needle.
Figure 1D:
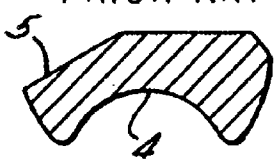
FIG. 1D. PRIOR ART
FIG. 1D is a cross-section through line D—D in FIG. 1B.
Figure 1C:
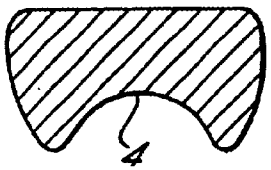
FIG. 1C. PRIOR ART
FIG. 1C is a cross-section through line C—C in FIG. 1B.

The conventional needle will first be described with reference to FIGS. 1A–1D and 2. The needle has an elongate shank 1 at one end of which is an eye 2, and the other end 3 of which is mounted in a needle bar or needle module. A yarn protection groove 4 extends along the shank from a position adjacent to the mounted end 3 and into the eye 2. A hook lead in chamfer 5 is provided on the opposite side of the needle to the yarn protection groove 4. The lead-in chamfer 5 extends only along the portion of the needle adjacent to the eye 2. It can be seen, particularly from FIG. 1A that the needle has a wide variation of cross-sections along its length.

Figure 2:
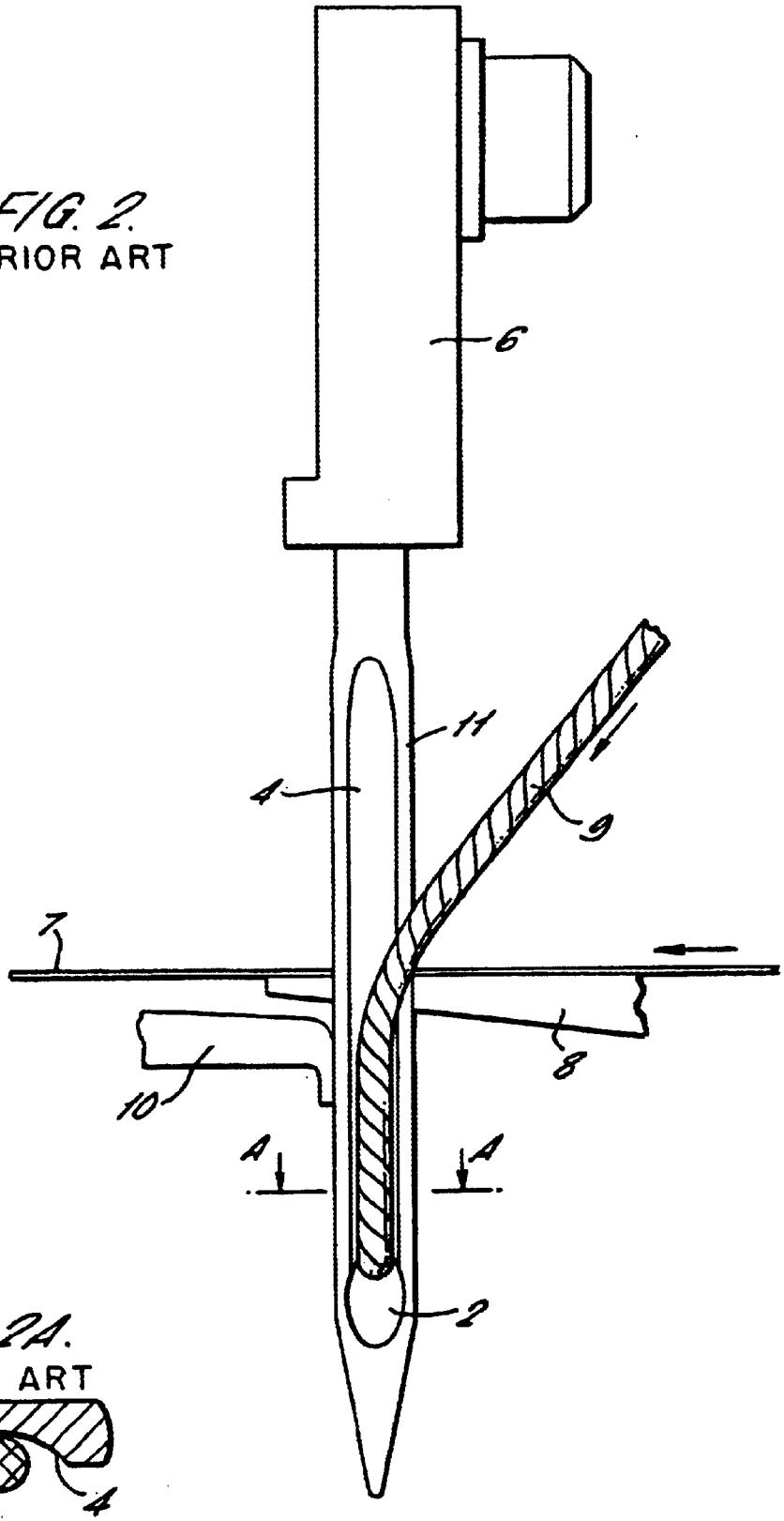
FIG. 2. PRIOR ART
FIG. 2 is a schematic showing a conventional needle in use in a tufting machine.
Figure 2A:
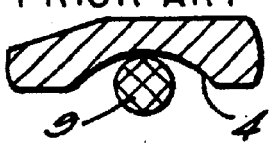
FIG. 2A. PRIOR ART
FIG. 2A is a cross-section through line A—A in FIG. 2.

The operation of the needle is shown in FIG. 2. The needle is shown mounted in a yarn module 6 in a tufting machine. A number of such needles are arranged perpendicular to the plane of FIG. 2. Backing cloth 7 supported on a series of support fingers 8 is then fed through a tufting machine from right to left in FIG. 2. A yarn 9 which is threaded through the eye 2 of the needle is reciprocated as the needle reciprocates. The yarn is picked up on each stroke by a reciprocating hook 10 to form a series of loops as is well known in the art.

Initially, the tip of the needle penetrates the backing cloth 7 whereupon the rest of the needle successively follows it through the backing cloth 7. When the needle has penetrated to a sufficient depth (i.e. once the eye 2 has passed through the backing cloth 7), the yarn 9 starts to become trapped between the needle and the backing cloth. The yarn protection groove 4 is designed to prevent this. However, in practice, the only point at which the yarn becomes trapped is at the point where the needle passes through the backing cloth 7. At this point, the yarn 9 passes around a wall 11 of the yarn protection groove, and this tends to roll or twist the yarn during the stroke. Thus, the yarn protection groove does not fulfil its intended function satisfactorily.

Figure 3:
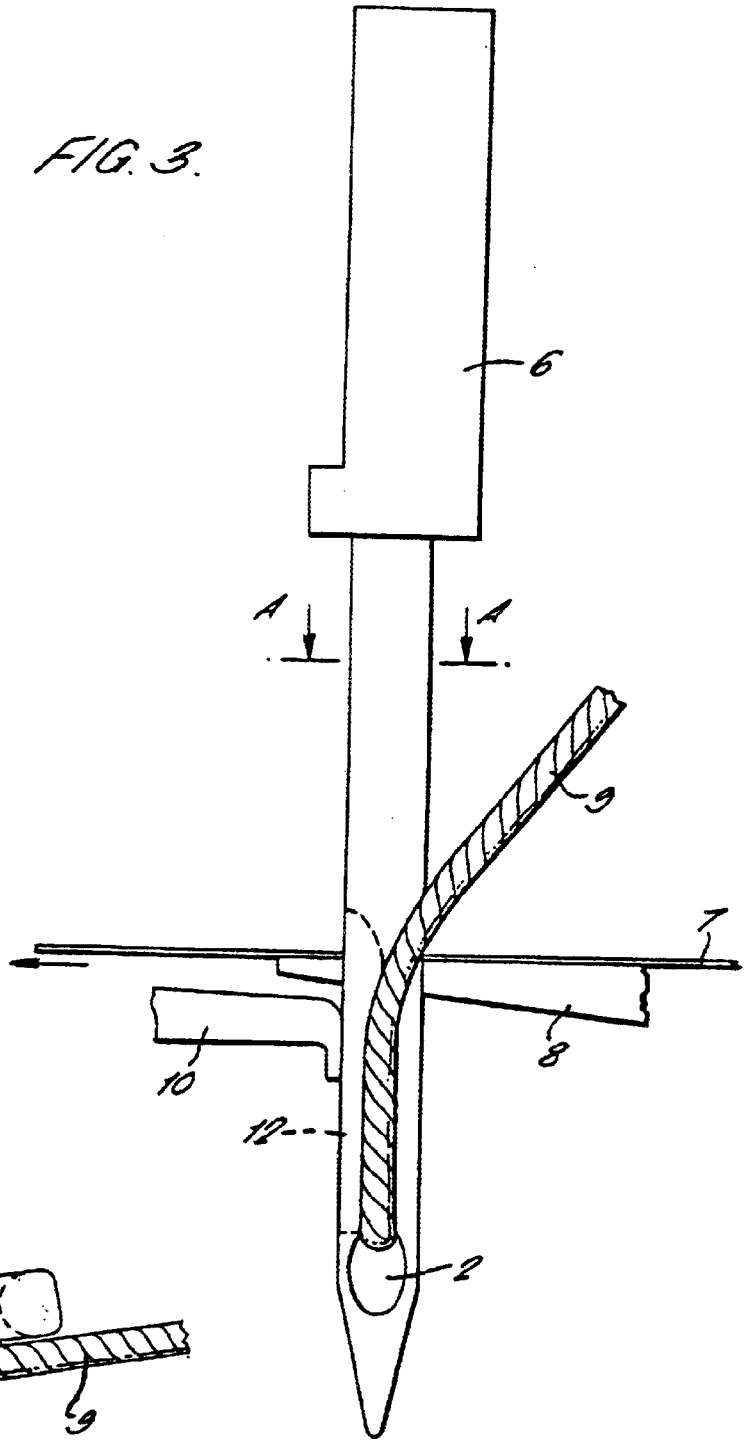
FIG. 3 is a view similar to FIG. 2 showing a first example of the present invention.
Figure 3A:
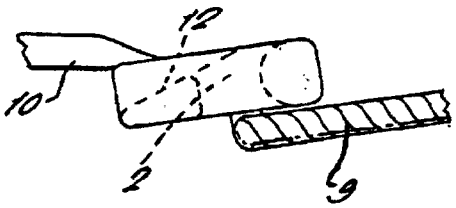
FIG. 3A is a cross-section through line A—A in FIG. 3.

The first example of the present invention will now be described with reference to FIG. 3. This figure is similar to FIG. 2, and common elements have been designated by common reference numerals. The only difference between FIGS. 2 and 3, is the configuration of the needle, and, in particular, the absence of the yarn protection groove. From the cross-section of the needle shown in FIG. 3A, it is apparent that the needle is made from a flat plate. It will also be seen that this flat plate is inclined with respect to the direction in which the backing cloth passes through the tufting machine.

It will be apparent from the comparison of FIGS. 1, 2 aid 3 that the needle of the present invention has a far more uniform cross-section than a conventional needle. It should be noted that the yarn 9 passes around the edge of the needle in a similar way to the way in which it passes around the wall 11 of the yarn protection groove 4. In this sense, the invention is believed to be comparable with a convention needle.

A hook lead-in chamfer 12 is provided on the needle, owing to the absence of the yarn protection groove, this chamfer can be made larger than the conventional needle.

Figure 4:
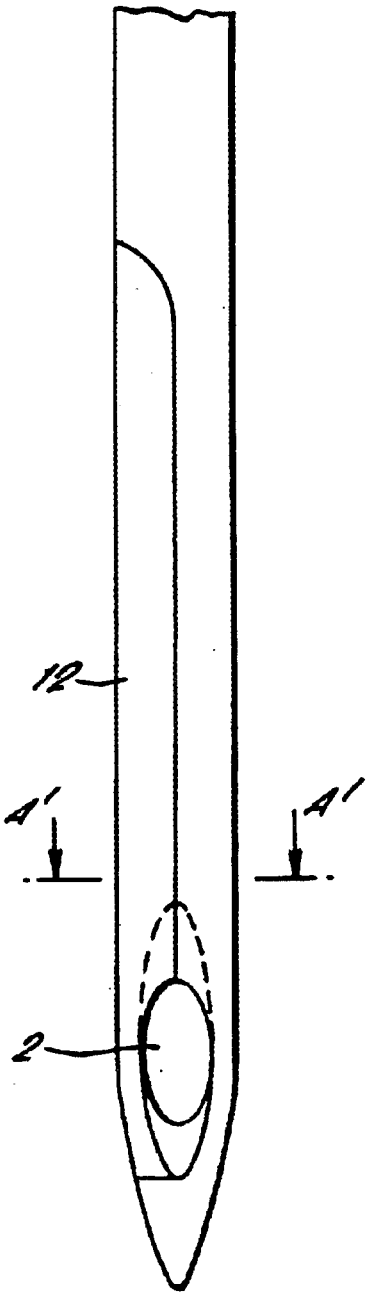
FIG. 4 is a schematic plan view of a needle in accordance with the second example of the present invention.
Figure 4A:
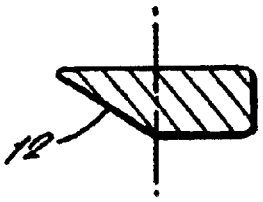
FIG. 4A is a cross-section through line A—A in FIG. 4.

A second example of a needle in accordance with the present invention is shown in FIGS. 4 and 4A. In this case, the needle is also of flat plate construction and has a hook lead-in chamfer 12. However, the flat plate is arranged generally parallel to the direction in which the backing cloth is fed through the tufting machine. However, equally, in FIG. 4A, the chamfer 12 could be provided on the opposite hand surface of the needle if the hook approaches from the same direction as in FIG. 3A.

Figure 5A:
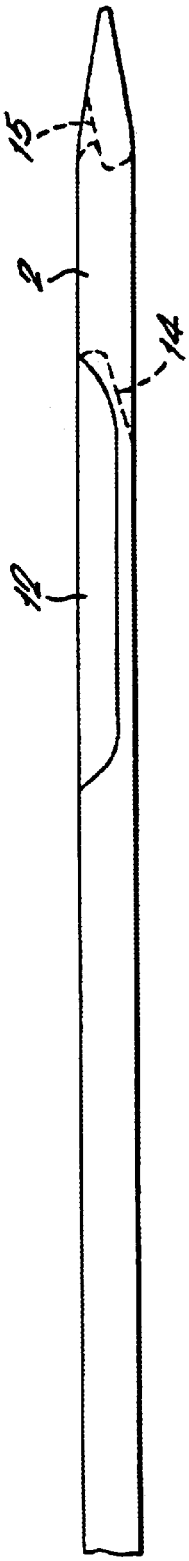
FIG. 5A is a schematic plan view of a needle in accordance with the third example of the present invention.
Figure 5B:
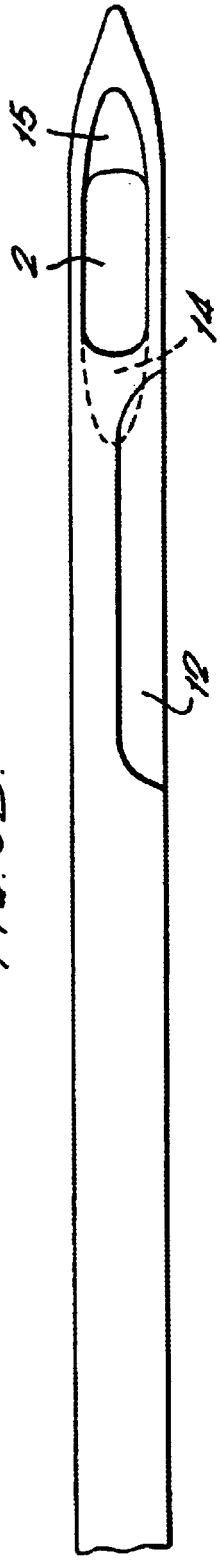
FIG. 5B is a side view of the needle of FIG. 5A.
Figure 5C:
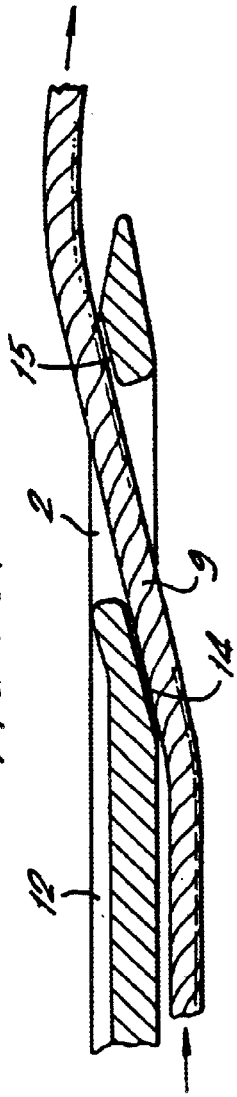
FIG. 5C is a cross-section through a tip of a needle.

A third example of a needle in accordance with the present invention is shown in FIGS. 5A–C. The needle has a hook lead-in chamfer 12 as in the previous example. In this case, the only difference is the presence of chamfer 14 on the inlet side of the eye 2 and a chamfer 15 on the outlet side of the eye 2. As will be appreciated from FIG. 5C, this provides a smoother path for the yarn through the eye 2.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A tufting needle including a shank having a longitudinal axis, a blade extending from said shank, an eye and point portion including a transverse eye connected to said blade and terminating in a point, a shoulder located at the junction of the eye and point portion with the blade, said shoulder located on a hook interfacing side of the blade, and a second side opposite to said hook interfacing side having a substantially uninterrupted surface intermediate the eye and the shank.

2. A tufting needle as recited in claim 1, wherein said uninterrupted surface is substantially flat.

3. A tufting needle as recited in claim 1, having a lead-in chamfer on said hook interfacing side which is the width of at least half of the width of said blade.

4. A tufting needle as recited in claim 2, wherein said uninterrupted surface lies in a plane and said plane is parallel to a longitudinal axis passing through said eye and said point.

* * * * *